US012053069B2

(12) United States Patent
Almond et al.

(10) Patent No.: US 12,053,069 B2
(45) Date of Patent: Aug. 6, 2024

(54) CONTACT LENS BLISTER PACKAGE WITH DOUBLE LAYER FOIL COMPONENT

(71) Applicant: CooperVision International Limited, Fareham (GB)

(72) Inventors: Sarah Almond, Southampton (GB); Carlos Ortiz, Pittsford, NY (US); Gary Hunt, Bristol (GB); Mike Nelson, Bristol (GB); Russell Beard, Bristol (GB); Thomas Harkin, Bristol (GB); Pauline Gavelle, Toulouse (FR)

(73) Assignee: COOPERVISION INTERNATIONAL LIMITED, Fareham (GB)

( * ) Notice: Subject to any disclaimer, the term of this patent is extended or adjusted under 35 U.S.C. 154(b) by 541 days.

(21) Appl. No.: 16/737,938

(22) Filed: Jan. 9, 2020

(65) Prior Publication Data

US 2020/0229561 A1 Jul. 23, 2020

Related U.S. Application Data

(60) Provisional application No. 62/795,293, filed on Jan. 22, 2019.

(51) Int. Cl.
*A45C 11/00* (2006.01)
*B65B 5/02* (2006.01)
(Continued)

(52) U.S. Cl.
CPC ..... *A45C 11/005* (2013.01); *B65B 5/02* (2013.01); *B65B 25/008* (2013.01); *B65D 75/366* (2013.01)

(58) Field of Classification Search
CPC . A45C 11/005; A45C 2011/006; B65D 77/20; B65D 2577/2041
(Continued)

(56) References Cited

U.S. PATENT DOCUMENTS 4,691,820 A 9/1987 Martinez
D299,085 S 12/1988 Martinez
(Continued)

FOREIGN PATENT DOCUMENTS

AU 739045 B2 10/2001
CN 203889304 U 10/2014
(Continued)

OTHER PUBLICATIONS

International Search Report and Written Opinion issued in corresponding International Patent Application No. PCT/GB2020/050111 dated Jul. 17, 2020 (18 pages).
(Continued)

*Primary Examiner* — Javier A Pagan
(74) *Attorney, Agent, or Firm* — Kilyk & Bowersox, P.L.L.C.

(57) ABSTRACT

A blister package for a contact lens is provided that includes a body and a seal, one or both of which is made up of a double layer foil component. The double layer foil component can be a seal component made of a sheet of material folded upon itself and defining a seal, a flap, and a fold. The seal and the flap intersect at the fold and the flap can be pulled away from the seal to form a pull tab useful to peel back the seal and open the bowl. The body can also, or instead, be made of a double layer foil component that forms at least the bowl such that the bottom of the bowl is double-walled. The double-walled bowl exhibits improved strength and can be provided with strengthening features such as ribs, ridges, channels, or grooves.

13 Claims, 9 Drawing Sheets

(51) Int. Cl.
*B65B 25/00* (2006.01)
*B65D 75/36* (2006.01)

(58) Field of Classification Search
USPC ..... 206/5.1
See application file for complete search history.

(56) References Cited

U.S. PATENT DOCUMENTS

| | | | | |
|---|---|---|---|---|
| D305,478 | S | 1/1990 | Lahm et al. | |
| 5,069,494 | A | 12/1991 | Reinson et al. | |
| 5,300,748 | A | 4/1994 | Colombo | |
| 5,409,104 | A | 4/1995 | Lovell | |
| 5,456,351 | A * | 10/1995 | Johnson | A47G 19/2227 206/19 |
| 5,609,246 | A | 3/1997 | Borghorst et al. | |
| 5,620,088 | A | 4/1997 | Martin et al. | |
| 5,685,420 | A | 11/1997 | Martin et al. | |
| 5,697,495 | A * | 12/1997 | Abrams | B65D 77/0413 206/5.1 |
| 5,704,468 | A | 1/1998 | Lust et al. | |
| 6,044,966 | A | 4/2000 | Haase | |
| 6,260,695 | B1 | 7/2001 | Tasber et al. | |
| 6,398,018 | B1 | 6/2002 | Livesley et al. | |
| 6,471,052 | B2 | 10/2002 | Faxe et al. | |
| 6,474,465 | B1 | 11/2002 | Jux | |
| 6,572,165 | B2 | 6/2003 | Faxe et al. | |
| 6,889,825 | B2 | 5/2005 | Ichikawa et al. | |
| 6,997,344 | B2 | 2/2006 | Brown et al. | |
| 7,086,526 | B2 | 8/2006 | Newman | |
| 7,168,746 | B2 | 1/2007 | Py | |
| 7,426,993 | B2 | 9/2008 | Coldrey et al. | |
| 7,431,152 | B2 | 10/2008 | Marmo | |
| 7,477,366 | B2 | 1/2009 | Clements et al. | |
| 7,699,161 | B2 | 4/2010 | Tokarski et al. | |
| 7,770,732 | B2 | 8/2010 | Stroppolo et al. | |
| 7,784,608 | B2 | 8/2010 | Tokarski et al. | |
| 7,789,266 | B2 | 9/2010 | Biel et al. | |
| 7,816,455 | B2 | 10/2010 | Marmo | |
| 8,061,897 | B2 | 11/2011 | Ichikawa et al. | |
| 8,069,979 | B2 | 12/2011 | Newman et al. | |
| 8,281,920 | B2 | 10/2012 | Tokarski et al. | |
| 8,317,016 | B2 | 11/2012 | Tokarski et al. | |
| 8,459,445 | B2 | 6/2013 | Newman | |
| 8,833,548 | B2 | 9/2014 | Hsieh et al. | |
| 8,955,672 | B2 | 2/2015 | Newman | |
| 9,095,670 | B2 | 8/2015 | Briant et al. | |
| 9,119,450 | B2 | 9/2015 | Lee et al. | |
| 9,173,463 | B2 | 11/2015 | Clamp et al. | |
| 9,439,487 | B2 | 9/2016 | Barre et al. | |
| 9,655,423 | B1 | 5/2017 | Wang | |
| 9,701,458 | B2 | 7/2017 | Barrows et al. | |
| 9,839,270 | B2 | 12/2017 | Howell et al. | |
| D813,537 | S | 3/2018 | Miura et al. | |
| 10,092,075 | B2 | 10/2018 | Barre et al. | |
| 2006/0054514 | A1 | 3/2006 | Tokarski et al. | |
| 2006/0260957 | A1 | 11/2006 | Hamilton | |
| 2007/0119720 | A1 | 5/2007 | Marmo | |
| 2008/0023345 | A1 | 1/2008 | Tokarski et al. | |
| 2009/0139879 | A1 | 6/2009 | Tokarski et al. | |
| 2010/0300902 | A1 | 12/2010 | Marmo | |
| 2012/0055817 | A1 | 3/2012 | Newman et al. | |
| 2012/0267262 | A1 | 10/2012 | Wang et al. | |
| 2014/0246337 | A1 | 9/2014 | Newman | |
| 2014/0262845 | A1 | 9/2014 | Newman | |
| 2015/0114851 | A1 * | 4/2015 | English | B65D 75/326 206/5.1 |
| 2017/0086552 | A1 | 3/2017 | Michalos | |
| 2017/0096272 | A1 | 4/2017 | Coon et al. | |
| 2017/0165901 | A1 | 6/2017 | Fischer et al. | |
| 2018/0125189 | A1 | 5/2018 | Barre et al. | |
| 2019/0008251 | A1 | 1/2019 | Kim | |

FOREIGN PATENT DOCUMENTS

| | | | |
|---|---|---|---|
| DE | 202007013893 | U1 | 11/2007 |
| EP | 0223581 | A2 | 5/1987 |
| EP | 0734958 | A1 | 10/1996 |
| GB | 2418418 | A | 3/2006 |
| JP | 2008253746 | A | 10/2008 |
| JP | 5466344 | B1 | 4/2014 |
| JP | 5676760 | B2 | 2/2015 |
| JP | 2016221059 | A | 12/2016 |
| LU | 88593 | A1 | 9/1995 |
| WO | 9927813 | A1 | 6/1999 |
| WO | 2006105179 | A1 | 10/2006 |
| WO | 2009102273 | A1 | 8/2009 |
| WO | 2011112998 | A2 | 9/2011 |
| WO | 2012131786 | A1 | 10/2012 |
| WO | 2012168964 | A1 | 12/2012 |
| WO | 2013136361 | A1 | 9/2013 |
| WO | 2013153582 | A1 | 10/2013 |
| WO | 2014195588 | A1 | 12/2014 |
| WO | 2017137738 | A1 | 8/2017 |

OTHER PUBLICATIONS

Search and Examination Report issued in corresponding United Kingdom Patent Application No. GB2208463.6 dated Aug. 24, 2022 (6 pages).

* cited by examiner

CONTACT LENS BLISTER PACKAGE WITH DOUBLE LAYER FOIL COMPONENT

FIELD

This application claims the benefit under 35 U.S.C. § 119(e) of prior U.S. Provisional Patent Application No. 62/795,293, filed Jan. 22, 2019, which is incorporated in its entirety by reference herein.

The present invention relates to contact lens packaging and methods, and more specifically, to blister packages for sealed contact lenses containing unworn contact lenses, and methods of manufacturing contact lens packages.

BACKGROUND

Contact lenses, such as hydrogel and silicone hydrogel contact lenses, are frequently packaged in sealed blister packages or blister packs that permit storage of the unworn contact lenses in a sterile environment. For instance, a blister package which is adapted to provide a sterile sealed storage environment for a disposable or single-use hydrophilic contact lens, wherein the lens is immersed in a sterile aqueous solution, for example, such as in an isotonic saline solution, is described in Martinez, U.S. Pat. No. 4,691,820. Additional contact lens packages are disclosed in U.S. Pat. Nos. 4,691,820; 5,054,610; 5,337,888; 5,375,698; 5,409,104; 5,467,868; 5,515,964; 5,609,246; 5,620,088; 5,695,049; 5,697,495; 5,704,468; 5,711,416; 5,722,536; 5,573,108; 5,823,327; 5,704,468; 5,983,608; 6,029,808; 6,044,966; and 6,401,915.

As an example of part of a manufacturing process, a newly manufactured unworn contact lens will be placed in a cavity or bowl of a plastic base member of a contact lens blister package, a contact lens packaging solution will be provided in the blister package cavity, and a foil sealing member will be adhered to the blister package to hermetically seal the contact lens in the packaging solution in the cavity. In other words, a contact lens blister package used in the manufacture of contact lenses contains a base member having a cavity or bowl, an unworn contact lens provided in a packaging solution within the cavity, and a sealing member sealed to the base member to provide an air tight seal around the perimeter of the cavity. The sealed blister package containing the contact lens is then autoclaved to sterilize the contact lens in the packaging solution in the cavity. Multiple blister packs are then placed in cartons. The cartons are considered secondary packaging. The blister packs are understood to be primary packaging.

SUMMARY

The present invention provides a blister package for a contact lens that includes a body and a seal, one or both of which is made up of a double layer foil component. The double layer foil component can be a seal component made of a sheet of material folded upon itself and defining a seal, a flap, and a fold. The seal and the flap intersect at the fold and the flap can be pulled away from the seal to form a pull tab useful to peel back the seal and open the bowl. The body can also, or instead, be made of a double layer foil component that forms at least the bowl such that the bottom of the bowl is double-walled. The double-walled bowl exhibits improved strength and can be provided with strengthening features such as ribs, ridges, channels, or grooves, addresses this need.

The blister package can be manufactured from a single piece of material, for example, foil material, comprising three sections folded together at two different fold lines. A middle section can be deformed into the shape of a bowl or well for retaining a contact lens, a bottom or outer section can be deformed into the shape that accommodates the bowl and is outside of and protects the bowl by including strengthening features such as ribs, ridges, channels or grooves, and a top section can provide a planar seal for sealing the top of the middle section including the bowl.

As discussed herein, new contact lens packaging and methods of manufacturing contact lens packages are described. In general, as described herein, a contact lens package is provided. The contact lens package so described can be made of a single piece of foil that includes two base layers providing a reinforced bowl, and a foil seal layer. An unworn contact lens is provided in a contact lens packaging solution in the bowl then the seal layer is folded onto the base layers. The sealed device is referred to herein as a sealed contact lens package or sealed contact lens blister package. The present contact lens package, when opened, presents a beach area that facilitates the removal of the contact lens by a fingertip, reducing a need for digging into the bowl to retrieve the lens.

A method of manufacturing a contact lens blister package is also provided. A single sheet of material such as foil can be folded at two different fold lines to create three sections that can be laminated together to form a double-layer body and single-layer lid having a contact lens and contact lens solution sealed there between.

Other aspects and details of the present invention will be apparent based on the following drawings, detailed description, and claims.

DETAILED DESCRIPTION

Figure 1:
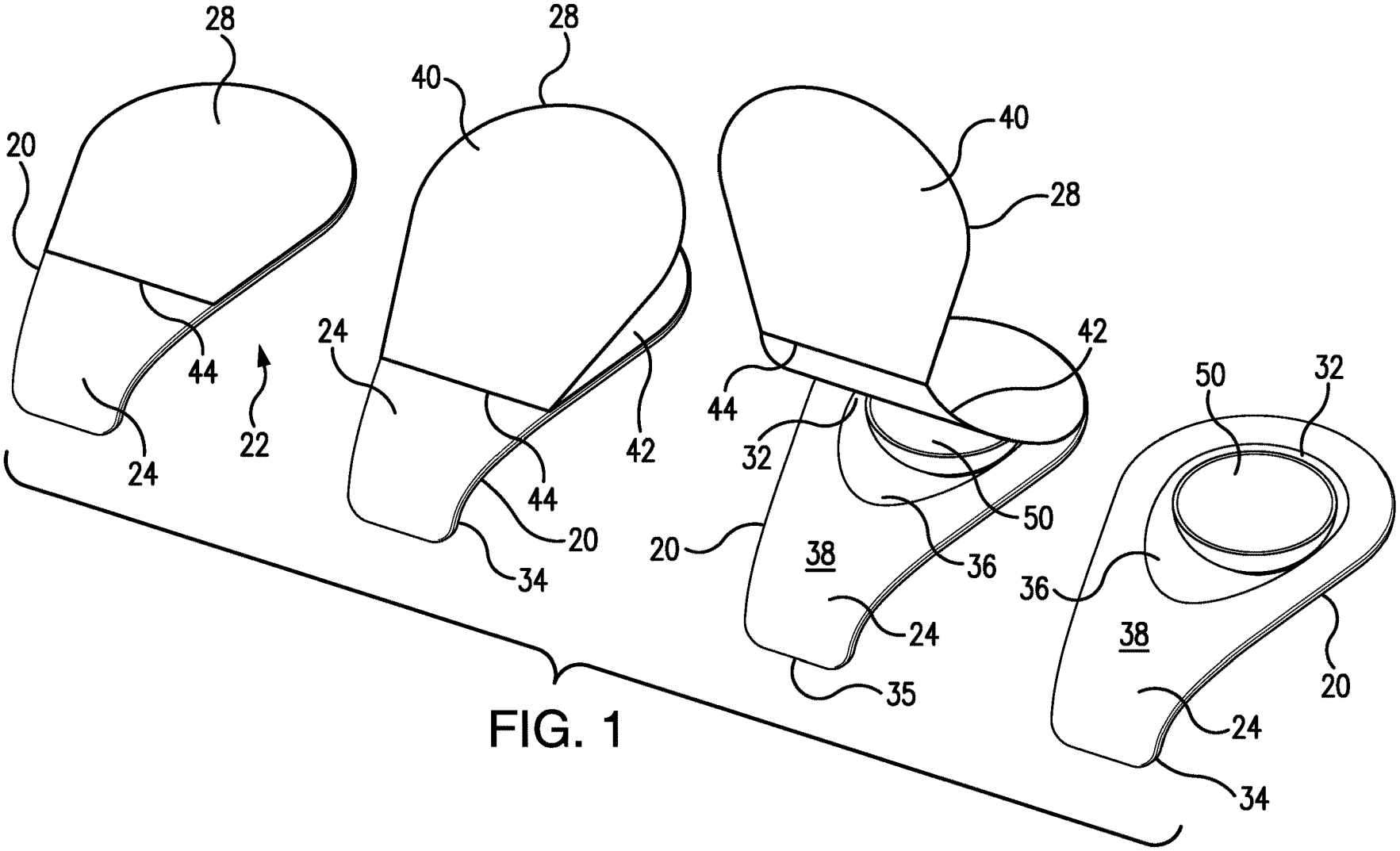
FIG. 1 shows a series of steps involved with opening a blister package according to an embodiment of the present invention.

According to the present invention, a blister package for a contact lens is provided. The blister package comprises a body and a seal and at least one of the body and the seal comprises a double foil layer. The body can comprise a handle, a bowl, and a body top surface. The bowl can be recessed from the body top surface. The handle can extend away from the bowl and terminate at a distal end. The body top surface can define a bowl perimeter sealing surface. In a first exemplary embodiment, the seal comprises a double layer foil component comprising a sheet of material folded upon itself. The double layer foil component can define the seal, a flap, and a fold. The seal and the flap intersect at the fold. The seal contacts the bowl perimeter sealing surface around the perimeter of the bowl and seals the bowl. The flap is configured to be pulled away from the seal to form a pull tab. The pull tab is configured to be pulled so that the seal can be separated from the bowl perimeter sealing surface and the bowl can be opened.

The seal can be adhered or heat-bonded to the body top surface. The fold can contact the body between the bowl and the distal end of the handle or can extend to the distal end of the handle. The fold can contact the body at a line along the handle. The seal has a shape and the flap can have a shape that mirrors the shape of the seal. The handle has a top surface and the seal can be adhered or heat-bonded to the body at the body top surface and along a portion of the top surface of the handle. The handle can extend from the body top surface and curve downwardly to the distal end. The body has a bottom surface including an outer bottom surface of the bowl, and the outer bottom surface of the bowl can be arranged on a first plane. The distal end of the handle can terminate at the first plane or the distal end can extend past or stop before reaching the first plane. The handle has a length and the fold can be disposed at a line along the handle, about midway along the length of the handle.

The bowl can contain a contact lens when the blister package is sealed, and the flap can comprise indicia thereon pertaining to a prescription of the contact lens. The flap can comprise a computer readable code, a bar code, an expiration date, or other information formed thereon pertaining to the contact lens. The blister package body has a maximum width and the pull tab can have a maximum width that is equal to the maximum width of the body.

The body can comprise a double layer foil component, at least in an area defining the bowl. The double layer foil component can comprise a foil material, for example, a metal foil material such as an aluminum foil. The double layer foil component can comprise an inner layer that defines the shape of the bowl and provide an inner surface of the bowl, and an outer layer that defines a bowl support indentation, for example, having strengthening ribs, channels, grooves, or other strengthening features. The bowl has a depth and a beach can be provided that intersects with the bowl. The beach can have a depth that is shallower than the depth of the bowl. The bowl perimeter sealing surface can surround a top opening of the bowl and the beach.

The present invention also provides an assembly comprising a plurality of blister packages, with each blister package comprising a blister package as described herein. Each blister package has a bowl end and a handle end, and, in the assembly, the blister packages are alternately arranged such that, for each adjacent pair of blister packages, the bowl end of one blister package is arranged next to the handle end of the other blister package of the pair.

According to the present invention, a method is also provided, for opening a blister package as described above. The blister package can comprise a body and a double layer foil component. The body can comprise a handle, a bowl, and a body top surface. The bowl can be recessed from the body top surface. The handle can extend away from the bowl and terminate at a distal end. The body top surface can define a bowl perimeter sealing surface. The double layer foil component can comprise a sheet of material folded upon itself and defining a seal, a flap, and a fold, with the seal and the flap intersecting at the fold. The seal contacts the bowl perimeter sealing surface around the perimeter of the bowl and seals the bowl. According to an exemplary method, the flap is pulled away from the seal to form a pull tab. The pull tab is then pulled to separate the seal from the bowl perimeter sealing surface, thus opening the bowl. The flap can be pulled in a direction from the bowl end of the blister package toward the handle, to form the pull tab extending from the body top surface. The pull tab is then pulled away from the handle to separate the seal from the bowl perimeter sealing surface. The method can involve first holding the handle between a thumb and a finger of a first hand, and then grabbing the flap with a thumb and finger of a second hand before pulling the flap.

According to another exemplary embodiment of the present invention, a blister package for a contact lens is provided that includes a body defining a bowl and comprising a double wall of a foil material. The double wall of foil material defines a sidewall and bottom of the bowl such that at least the bottom of the bowl is double-walled. The body can further comprise a handle and a body top surface. The bowl has a depth, is recessed from the body top surface, and has a top opening. The handle extends away from the bowl and terminates at a distal end. The body top surface defines a perimeter sealing surface surrounding the top opening of the bowl. After a new, unused contact lens is placed in the bowl, the bowl can be sealed with a seal contacting the perimeter sealing surface, for example, adhered or heat-bonded to the perimeter sealing surface.

The seal can also comprise a double layer foil component, for example, a sheet of material folded upon itself and defining a seal portion, a flap, and a fold. Thus, both the body and the seal can comprise double layer materials. The seal portion and the flap can intersect at the fold. The seal portion can contact the perimeter sealing surface around the perimeter of the bowl and seals the top opening of the bowl. The flap can be configured to be pulled away from the seal to form a pull tab. The pull tab can be configured to be pulled so that the seal portion can be separated from the perimeter sealing surface and the bowl can be opened. The entire seal portion can be adhered to the body top surface, except for in an area above the bowl. The fold can contact the body between the bowl and the distal end of the handle. The entire body can comprise a double layer of foil material, including an inner layer and an outer layer. The inner layer can define the bowl and can have a top surface that defines an inner surface of the bowl. The outer layer can comprise strengthening ribs, channels, grooves, ridges, or other strengthening features and can define a bowl support indentation for receiving the bowl formed in the inner layer.

The present invention also provides a method of forming a blister package having a double-walled bowl. The blister package comprises a body and a seal and the body comprises a handle, a bowl, and a body top surface. The bowl has a depth, is recessed from the body top surface, and has a top opening. The body comprises a double wall of a foil material defining a sidewall and a bottom of the bowl such that the bottom of the bowl is double-walled. The handle extends away from the bowl and terminates at a distal end. The body top surface defines a perimeter sealing surface surrounding the top opening of the bowl. The method comprises placing a contact lens and contact lens packaging solution in the double-walled bowl and sealing the seal against the perimeter sealing surface to seal the bowl. The method also comprises forming the double-walled bowl and the forming can comprise forming the body from a single piece of material. An inner body layer can be deformed or otherwise formed into the shape of the bowl, using a first section of a single piece of material. An outer body layer can be deformed or otherwise formed to include a bowl support indentation in a second section of the single piece of material. The second section can be adjacent to the first section and can be part of the same single piece of material.

The method can involve folding the first section against the second section at a fold, for example, a score line, at an intersection between the first section and the second section. The folding along the score line of the fold can be situated such that the bowl formed in the inner body layer is received in the bowl support indentation formed in the outer body layer. Together, the inner body layer and outer body layer form a double-walled body including the double-walled bowl. Once the body including the double-walled bowl is formed, the method can comprise placing a contact lens and contact lens packaging solution in the bowl and sealing the bowl, along the perimeter sealing surface, with the seal. The method can further comprise subsequently peeling the seal away from the perimeter sealing surface to open the bowl. The double wall and strengthening features greatly increase the strength and bend resistance of the blister package compared with a similar blister package but made with only a single bowl-defining foil layer.

The blister package body includes a bowl for containing a contact lens immersed in an amount of a solution. The term "contact lens" as used herein is intended to embrace an ophthalmic lens which is to be worn on the eye of an individual. The top surface of the body includes a peripherally located perimeter region at least partially surrounding an opening of the bowl. The handle can include a grip region. The flexible top is designed to cover and sealingly enclose the contact lens and solution within the bowl.

The body of the blister package can be formed of a plastic material that can be shaped by injection molding or thermoforming. The plastic material used to make the body can comprise polypropylene, polyethylene, polystyrene, or another thermoplastic material. One or more portions of the body material, particularly in the bowl, can have a vapor transmission of less than 10 grams/100 square inches/24 hours at 70° F. and 50 percent relative humidity.

As stated above, the body of the blister package can comprise a variety of structures, such as a relatively rigid material or a flexible material. The base member of the sealed blister package can be a thermoplastic material or an injection molded material, and the base member can include a bowl and a substantially planar body top surface surrounding the bowl. The substantially planar body top surface provides a sealing surface for sealing the flexible top. The body can be made from a variety of materials. The body can be formed using conventional methods and equipment, such as by injection molding polypropylene resin into body molds in an injection molding machine. The flexible top can also be formed from a variety of materials. For example, the flexible top can be a laminated structure comprising a foil and one or more layers of plastic, such as polypropylene and the like. The flexible top can include human readable information, as desired. The flexible top can be coupled to the body top surface by contacting the sealing surface of the body with the flexible top and applying heat to fuse the two members together to provide a hermetic or airtight seal for the contact lens and the packaging solution in the bowl.

The perimeter of the bowl can be contiguous with the circumference of the bowl. The perimeter can include a flange region, for example, extending about 5 mm from the opening of the bowl to a grip region. In an exemplary embodiment, the overall dimensions of the blister package can be approximately 30 mm wide, about 47 mm long and about 10 mm high. It should be appreciated, however, that the package can have any size and/or shape.

The bowl holds in a fluid tight manner, a contact lens and solution. The bowl is bounded by a seal area that is part of the flange region. The flexible top can be attached to the body by heat-sealing in the seal area; however, induction-sealing, sonic welding, or other bonding systems can be used to attach the flexible top to the body. The total interior volume defined by the bowl, once sealed, can be about 2.2 ml or less. The interior volume can be, for example, from about 0.5 ml to about 2.5 ml.

The flexible top can comprise at least two elements, for example, at least two different, separate layers of material. For example, the flexible top can comprise a first member, or first layer, and a second member, or second layer overlaying the first member. The first member can be made of a laminate material that is heat sealed to the seal region of the blister package body. The second member can comprise a foil material, sealed to the rim portion of the body. The second member can comprise at least one, for example two, polymer layers, e.g. polypropylene, coating the foil. The foil can comprise aluminum. The polymer coating material on the heat seal side of the foil can be polypropylene. Examples of useful cover layers are described in U.S. Pat. No. 4,691,820 that is incorporated herein in its entirety by reference. The second member can be sealed to the body along an entire circumference of the body surrounding the bowl, so as to provide a sanitary or sterile covering, for example, by means of a hermetic seal.

An unworn contact lens is sealed within the bowl of the sealed contact lens blister package and is packaged in a contact lens packaging solution. Any contact lens can be packaged therein. For example, the contact lens can be a hydrogel contact lens or it can be a silicone hydrogel contact lens. Examples of contact lenses that can be provided in the packages include those having the following United States Adopted Names (USANs): methafilcon A, ocufilcon A, ocufilcon B, ocufilcon C, ocufilcon D, omafilcon A, omafilcon B, comfilcon A, enfilcon A, stenfilcon A, etafilcon A, senofilcon A, senofilcon B, senofilcon C, narafilcon A, narafilcon B, balafilcon A, samfilcon A, lotrafilcon A, lotrafilcon B, somofilcon A, riofilcon A, delefilcon A, and the like.

The fluid medium or solution (i.e., the packaging solution) contained in the bowl can be any known solution useful for storing contact lenses including water, saline solutions, or buffered aqueous solutions. The contact lens and solution will preferably fill at least 50 percent, for example, at least 70 percent or at least 80 percent, of the total volume defined by the bowl once sealed by the flexible top. The contact lens packaging solution is typically a buffered saline solution, such as a phosphate buffered saline solution, or a borate buffered saline solution, that can contain one or more additives, such as surfactants, wetting agents, viscosity agents, and the like.

The blister package can also include a wrap that has one or more panels. The wrap can be dimensioned to accommodate the sealed contact lens package and to also provide a UDI in both human readable form and machine readable form, in addition to other required regulatory information. As used herein, a UDI is a "Unique Device Identifier". As used herein, a wrap refers to a substrate or article comprising one or more panels coupled to a sealed contact lens package, and an UDI in both human readable form and machine-readable form is provided on at least one of the panels. Such a wrap can be understood to be a "UDI wrap", or it can be understood to be a wrap having a "UDI panel". Thus, the wrap includes human readable information, such as letters, numbers, and images; and the wrap includes machine readable information, such as bar codes and the like. The wrap can be flexible or rigid and does not need to fully enclose or surround the individual sealed contact lens package. The wrap is coupled to the sealed contact lens package so that the wrap and sealed contact lens package do not become separated until a person opens the package to remove the unworn contact lens. For example, the wrap can be adhered to the sealed contact lens package, such as by using an adhesive between a surface of the wrap and a surface of the sealing member, or the wrap can be physically wrapped around the sealed contact lens package to mechanically enclose the sealed contact lens package within the wrap. Thus, the wrap cannot be inadvertently dislodged or separated from the sealed contact lens blister package.

Examples of blister package materials, methods of making blister package bodies, flexible tops, methods of making flexible tops, methods of sealing flexible tops to bodies, as well as other helpful components, materials, methods, and systems are described, for example, in U.S. Pat. Nos. 6,398,018, 7,426,993 B2, and 7,477,366 B2, in U.S. Patent Application Publications Nos. US 2012/0061260 A1, and US 2017/0096272 A1, and in WO 2013/160667, each of which is incorporated herein in its entirety by reference.

With reference to the drawing figures, each of FIG. 1 illustrates four sequential steps involved with opening a blister pack 20 according to an exemplary embodiment of the present invention. FIG. 1 shows the same single blister pack 20 at four different points in time during an opening procedure. To the far left of FIG. 1 is a new, unopened, and unpeeled blister package 22. Blister package 22 comprises a body 24 and a flexible top 28 sealing a contact lens 50 within a bowl 32 as can be seen in the last two states of the sequence. In the new, unopened state shown to the far left, flexible top 28 can be seen lying flat on body 24. Flexible top 28 is in the form of a double layer foil component. Body 24 defines bowl 32 and a handle 34. In the state shown at the far right, flexible top 28 has been completely removed from a top surface 38 of body 24. As can be seen in the second state from the left, a portion, namely, a flap 40, of flexible top 28, has been partially lifted away from body 24 forming a pull tab. As can also be seen in the second state from the left, another portion, namely, seal 42, of flexible top 28, remains adhered or bonded to top surface 38 of body 24.

In the state shown third from the left, flap or pull tab 40 has been pulled so as to begin to remove seal 42 from top surface 38. As can be seen from the middle two states, flap 40 and seal 42 intersect at a fold line 44 and are both parts of flexible top 28. Fold line 44 lies about mid-way between bowl 32 and a distal end 35 of handle 34, although fold line 44 can be made to fall closer or further from distal end 35. As can also be seen, flap or pull tab 40 has a maximum width that is equal to the maximum width of body 24. Flap or pull tab 40 is thus easy to grip and pull, facilitating removal of the seal and the entirety of flexible top 28 from body 24. Indicia including the prescription strength of the lens, a lot number, and an expiration date is provided on the exposed surface of flap or pull tab 40. As shown in the state to the far right, flexible top 28 has been completely removed from blister package 20, revealing not only bowl 32 but also a beach 36 extending from, but shallower than, bowl 32. Beach 36 is provided so a user can easily pull contact lens 50 from bowl 32 and effectively onto a shelf, i.e., beach 36, from where it can be easily manipulated and removed from the opened blister package.

Figure 2:
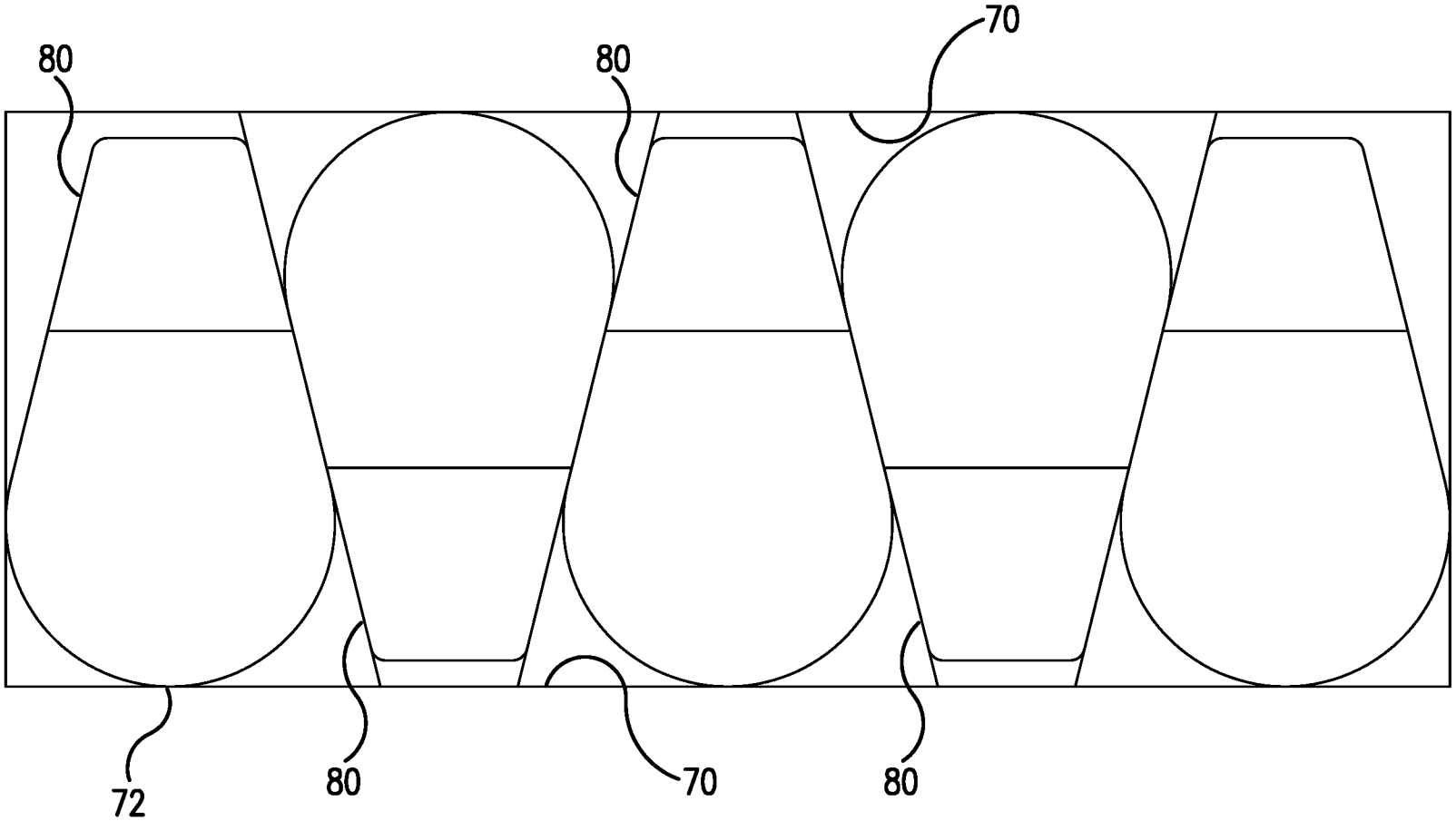
FIG. 2 shows a secondary package containing a plurality of blister packages according to an embodiment of the present invention.

FIG. 2 is a top view of an open blister package container 70 holding therein a plurality of blister packages 80 packed in an alternating fashion. Alternating the blister packages from left to right in container 70 most efficiently packs the multitude of blister packages 80 within container 70. Container 70 has a body 72 and can also comprise, for example, a hinged lid. Each blister package 80 can be of the same type as described above with reference to FIG. 1. Stacks of the blister packages can also be arranged and packed in a container, for example, stacked four or six deep, and alternating in orientation from top to bottom in each stack. At the same time, the stacks can alternate orientations with blister packages of the same level oriented oppositely.

Figure 3:
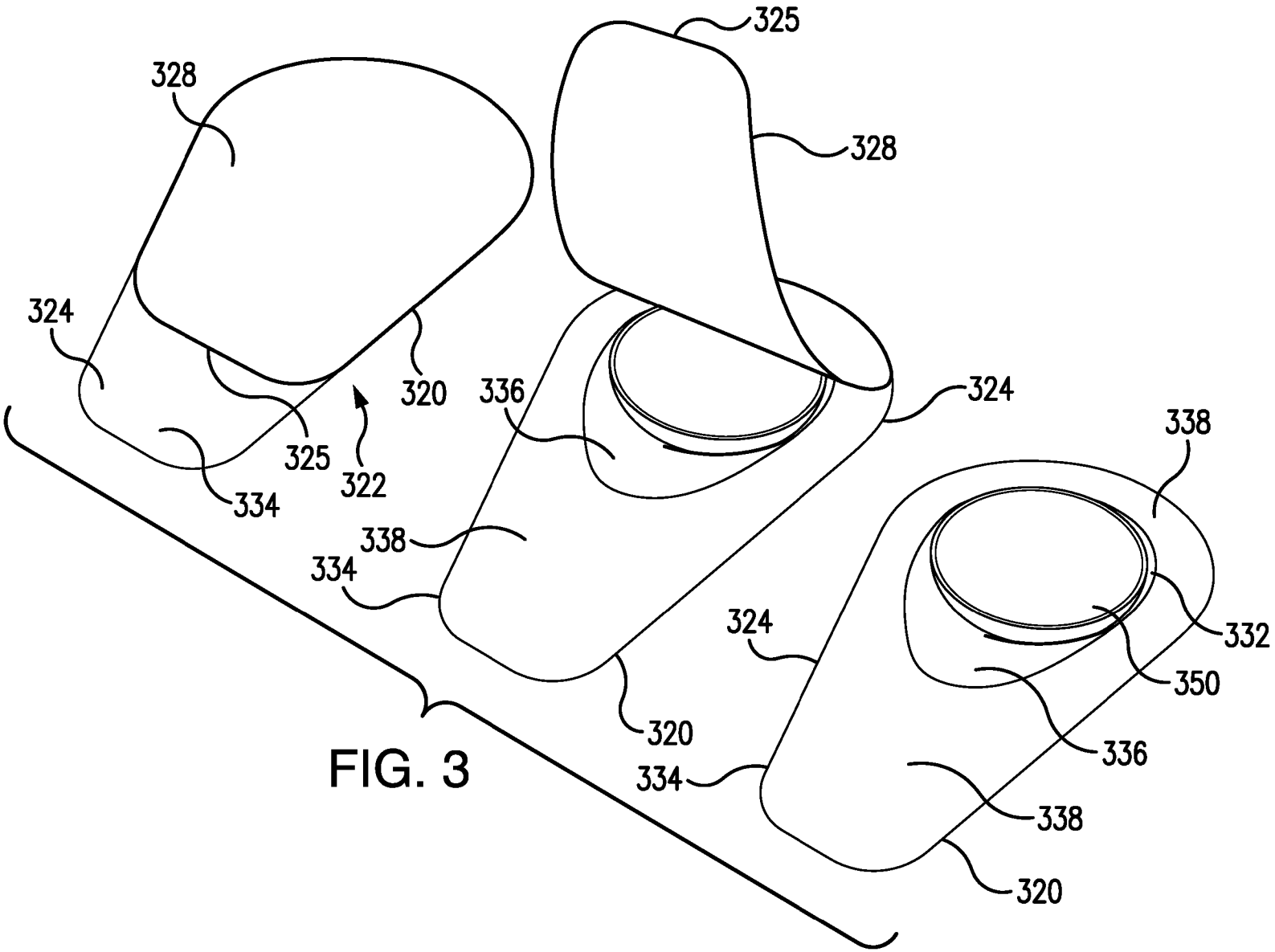
FIG. 3 shows a series of steps involved with opening a blister package according to another embodiment of the present invention.

FIG. 3 illustrates a blister package 320 according to another embodiment of the present invention and the sequential steps involved with opening blister pack 320. FIG. 3 shows the same single blister pack 320 at three different points in time during an opening procedure. To the far left of FIG. 3 is a new, unopened, and unpeeled blister package 322. Blister package 322 comprises a body 324 and a flexible top 328 sealing a contact lens 350 within a bowl 332. Contact lens 350 and bowl 332 can be seen in the last two states of the sequence. Body 324 is in the form of a double layer foil component, for example, having a two-layer type of body with one-layer lid, specifically, a three-layer structure as described below with reference to FIGS. 4A-5F. In the new, unopened state 322 of blister package 320, shown to the far left, flexible top 328 can be seen lying flat on body 324. Body 324 is in the form of a double layer foil component whereas flexible top 328 is in the form of a single layer foil seal. It is also to be understood that body 324 can be sealed with a double layer foil component seal such as flexible top 28 shown in FIG. 1.

Body 324 defines bowl 332 and a flat handle 334. In the state shown at the far right, flexible top 328 has been completely removed from a top surface 338 of body 324. As can be seen in the state shown in the middle of FIG. 3, a portion of flexible top 328 has been partially lifted away from body 324 to expose and open bowl 332. As can be seen, flexible top 328 has a maximum width that is equal to the maximum width of body 324. As can also be seen, flexible top 328 has a length that is shorter than the length of body 324 such that, as shown to the far left, a portion of handle 334 extends past an end 325 of flexible top 328. As such, the extending part of handle 334 can be bent down facilitating pulling flexible top 328 away from top surface 338. Flexible top 328 can be adhered or otherwise bonded to top surface 338 by a technique whereby the portion of the inner surface of flexible top 328 adjacent end 325 is not adhered or bonded to top surface 338 even further facilitating separation of flexible top 328 from body top surface 338.

Indicia including the prescription strength of the lens, a lot number, and an expiration date is provided on the top surface of flexible top 328. As shown in the state to the far right, flexible top 328 has been completely removed from blister package 320, revealing not only bowl 332 but also a beach 336 extending from, but shallower than, bowl 332. Beach 336 is provided so a user can easily pull contact lens 350 from bowl 332 and effectively onto a shelf, i.e., beach 336, from where it can be easily manipulated and removed from the opened blister package.

Figure 4A:
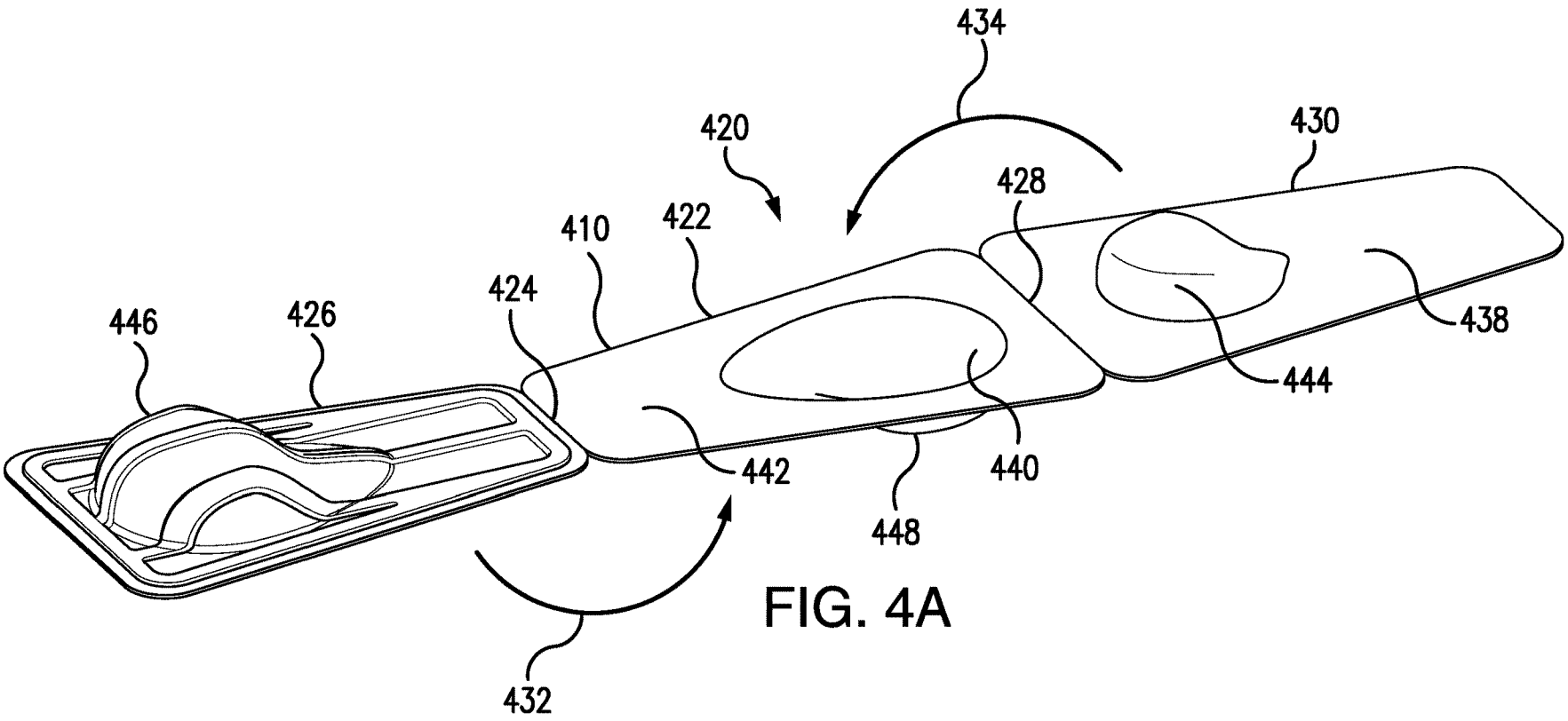
FIG. 4A shows a starting strip of material deformed to enable folding into a contact lens blister package according to yet another embodiment of the present invention.

FIGS. 4A-4D show yet another embodiment of the present invention that includes a folded single-sheet contact lens blister package 420. With regard to FIGS. 4A-4D, when the same reference numeral is used in more than one of the figures, it is the same feature that is represented. Blister package 420 is shown unfolded in FIG. 4A and can be manufactured from a single sheet of material 410. As shown in FIG. 4*a*, unfolded blister package 420 comprises a first section 422, a second section 426, and a third section 430. First section 422 folds together with second section 426 along a first fold line 424. To make the fold, second section 426 swings downwardly as shown by directional arrow 432 to form a protective outer layer underneath first section 422. After a contact lens (not shown) and contact lens solution (not shown) are disposed in a bowl 440 formed in first section 422, third section 430 can be folded along fold line 428 by swinging upwardly as shown by directional arrow 434 to act as a lid and seal bowl 440 with the contact lens and contact lens solution therein. The folding together results in surface 438 of third section 430 contacting and being sealed to top surface 442 of first section 422.

Third section 430 has an inverted bowl 444 formed therein, for example, deformed by a press, which generally conforms to the inner sidewall of bowl 440 leaving a gap between inverted bowl 444 and inner sidewall of bowl 440 to accommodate the contact lens and the volume of contact lens solution. During manufacture, an excess amount of contact lens solution can be used and is squeezed out when laminating or otherwise bonding sections 422 and 426 together. Second section 426 has an outer bowl 446 formed therein, for example, deformed by a press. The inside surface (not shown) of outer bowl 446 generally conforms to the outer shape and outer sidewall 448 of bowl 440 and can completely accommodate bowl 440 and outer sidewall 448. As a result, first section 422 fits firmly and flush against second section 426 when the two sections are folded together, with the exception of one or more gaps formed between outer sidewall 448 and the inside surface (not shown) of outer bowl 446. If present, the gaps can result from one or more strengthening features such as one or more ribs, one or more ridges, one or more channels, one or more grooves, or a combination thereof. Strengthening features can be included as a feature of section 426, section 422, or both.

Figure 4C:
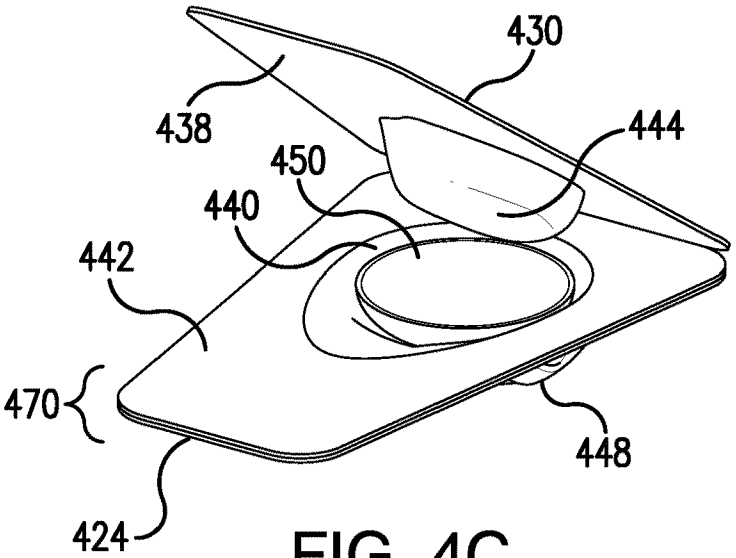
FIG. 4C shows the starting strip of material shown in FIGS. 4A and 4B partially laminated to form a double-layer contact lens blister package body, with a contact lens disposed in the bowl thereof, ready to be sealed by the lid.
Figure 4D:
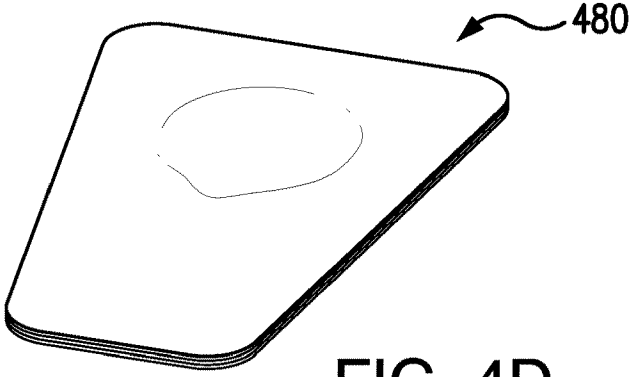
FIG. 4D shows a sealed three-layer contact lens blister package resulting from lamination of the folded starting strip of material shown in FIGS. 4A-4C, and according to an embodiment of the present invention.
Figure 4B:
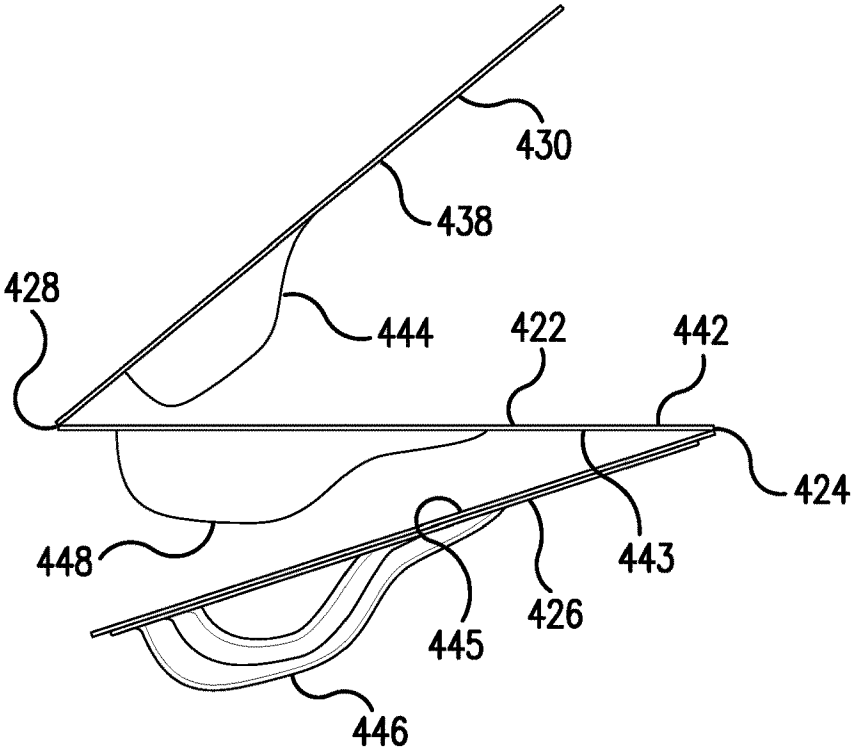
FIG. 4B shows the starting strip of material shown in FIG. 4A after folding has begun to fold the starting strip into the contact lens blister package.

FIG. 4B illustrates how bottom surface 443 of middle or first section 422, and top surface 445 of bottom or second section 426, come together during lamination to form a two-layer body 470 as depicted in FIG. 4C. Especially when second section 426 includes one or more strengthening features, double layer body 470 exhibits better tensile strength and resistance to deformation compared with either section 422 or 426 alone. As shown in FIG. 4C, a contact lens 450 and contact lens solution has been placed in bowl 440 and loaded double-layer body 470 is ready to be sealed by lid or third section 430. Lid or third section 430 can then be brought down so that bottom surface 438 lays flush against top surface 442 and the assembly can be laminated or otherwise sealed to form a sealed, three-layer contact lens blister package 480 as shown in FIG. 4D. It is to be understood that third section 430 can instead be, for example, completely planar such that the volume retained in sealed bowl 440 would be greater than the volume provided by the embodiment shown in FIGS. 4A-4D. An air space can be included, if desired, depending upon the volume of the sealed bowl and the volume taken-up by contact lens 450 and the contact lens solution.

Figure 5A:
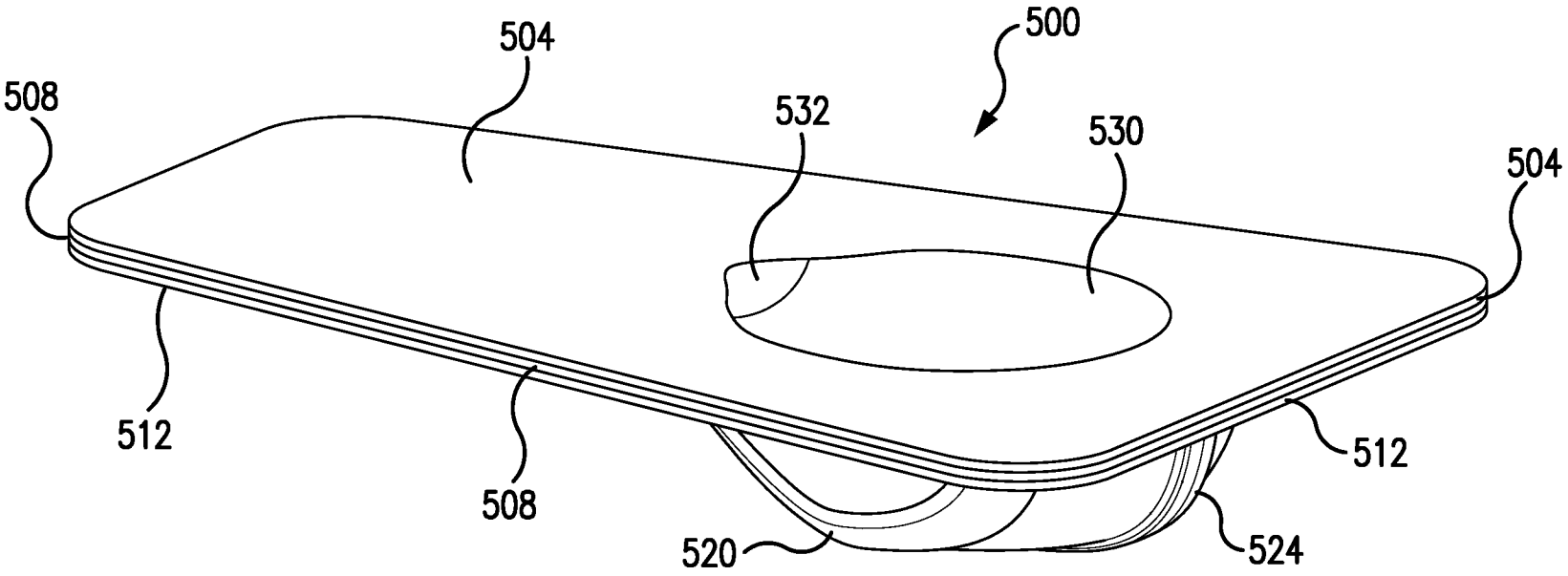
FIG. 5A is a front, top, right perspective view of a three-layer contact lens blister package according to an embodiment of the present invention.

FIGS. 5A-5F are various views of a three-layer contact lens blister package 500 according to an embodiment of the present invention. FIG. 5A is a front, top, right perspective view of contact lens blister package 500. Contact lens blister package 500 comprises a top layer or lid 504, a middle layer 508 defining a contact lens bowl, and a bottom or strengthening layer 512. Contact lens blister package 500 can be made from a single sheet of material, for example, as folded in accordance with the embodiment shown in FIGS. 4A-4D. Bottom layer 512 can be deformed during manufacture, for example, by a press, or molded or otherwise formed, to include strengthening ribs 520, 524, and 528.

Figure 5C:
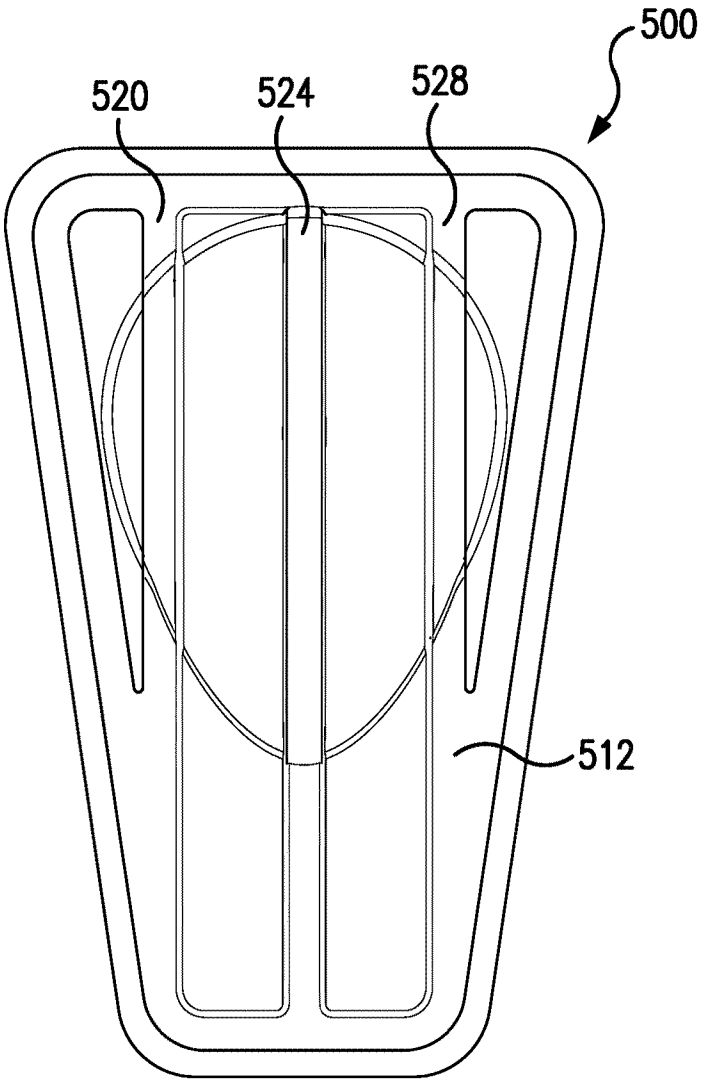
FIG. 5C is a bottom view of the three-layer contact lens blister package shown in FIGS. 5A and 5B.
Figure 5B:
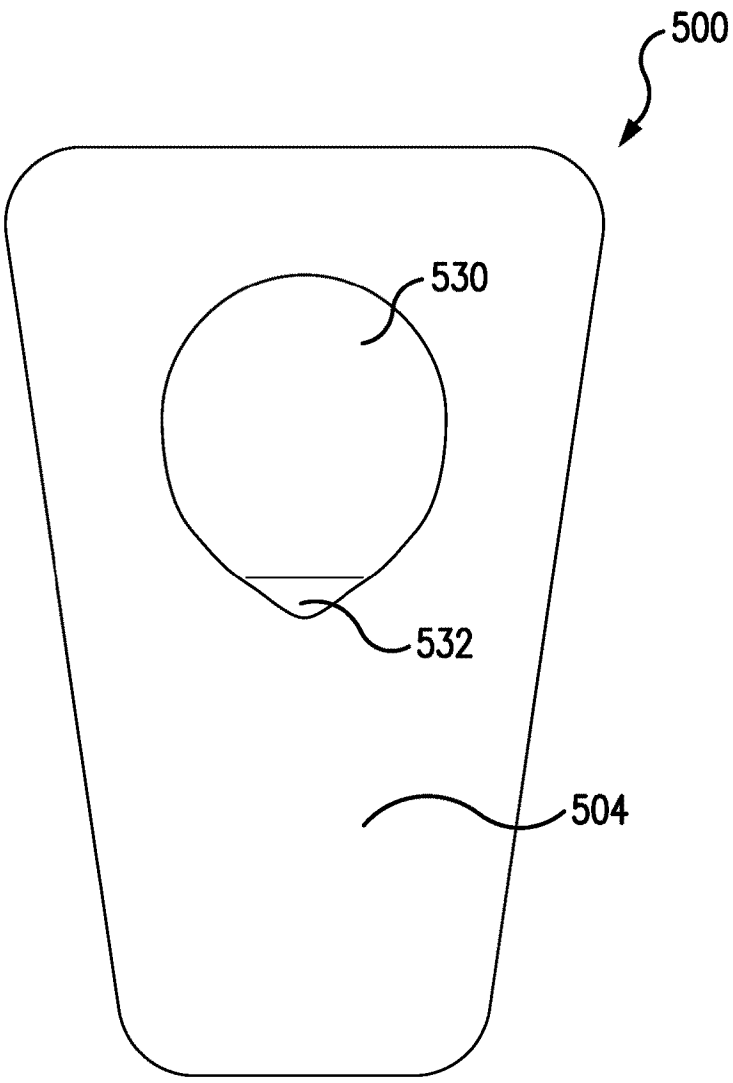
FIG. 5B is a top view of the three-layer contact lens blister package shown in FIG. 5A.
Figure 5D:
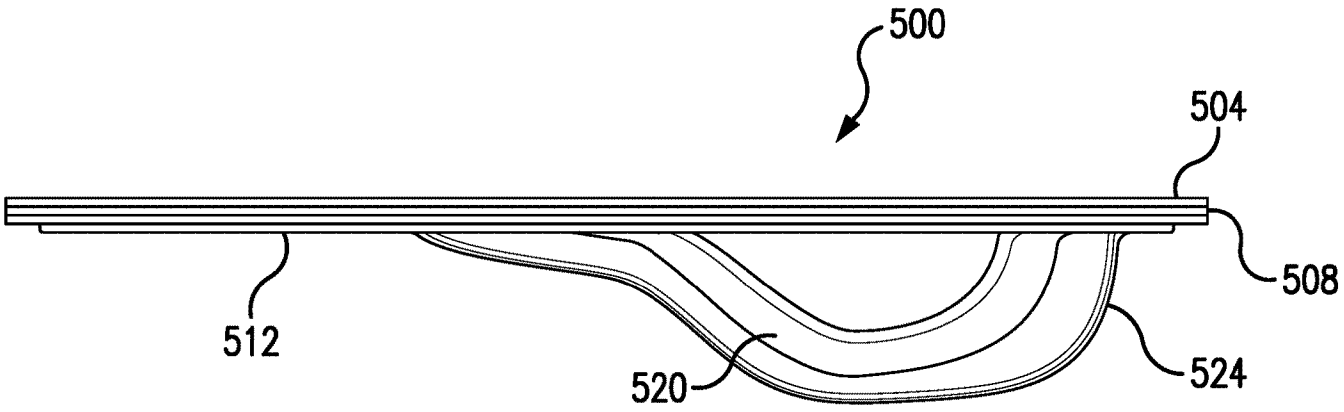
FIG. 5D is a right-side view of the three-layer contact lens blister package shown in FIGS. 5A-5C.
Figure 5E:
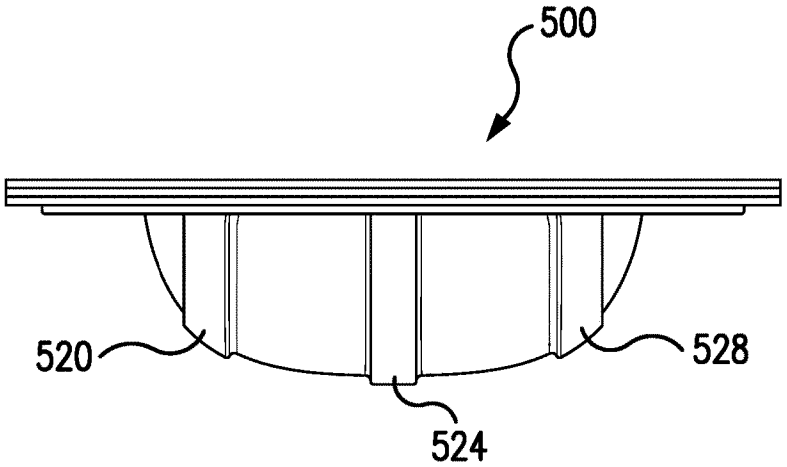
FIG. 5E is a front view of the three-layer contact lens blister package shown in FIGS. 5A-5D.
Figure 5F:
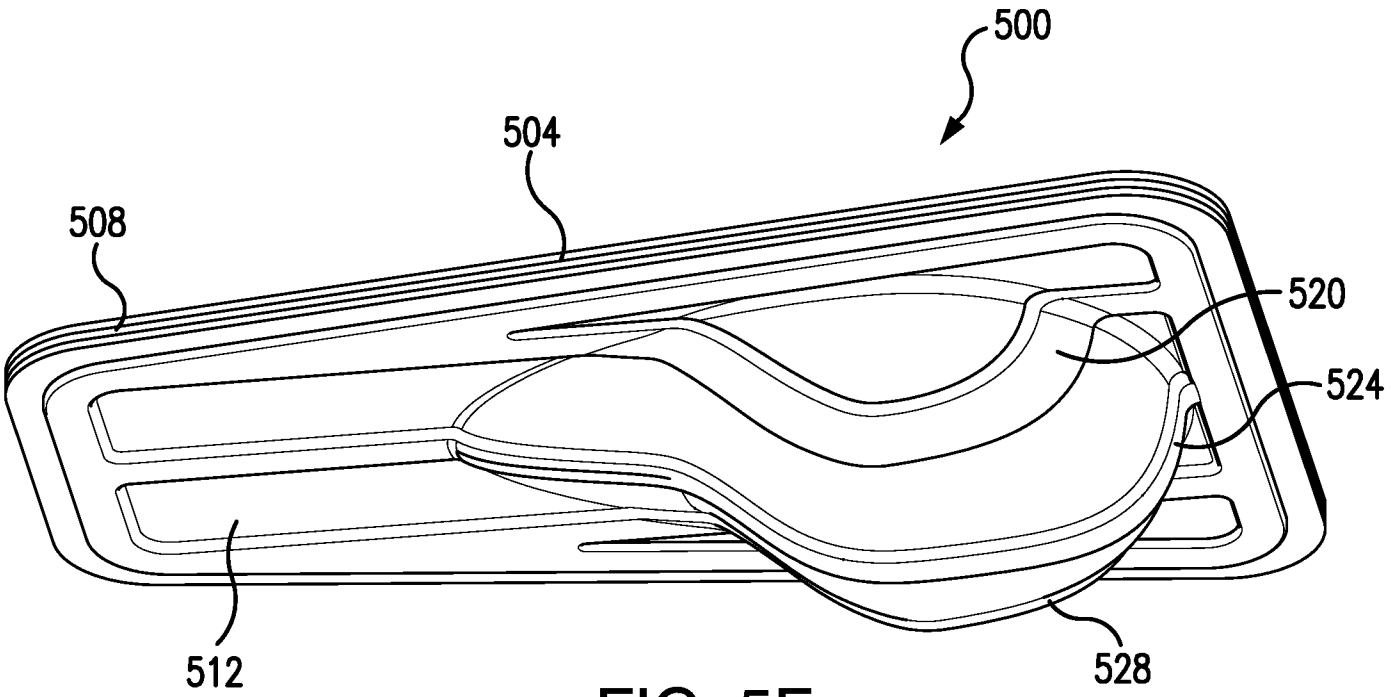
FIG. 5F is a front, bottom, right perspective view of the three-layer contact lens blister package shown in FIGS. 5A-5E.

FIG. 5B is a top view of contact lens blister 500. Lid 504 includes a depression 530 having an outer surface that is shaped to substantially conform to the shape of the inner sidewall of the contact lens bowl (not shown) formed in middle layer 508. Depression 530 includes a beach depression 532 having an opposing surface that substantially conforms to a beach from with the contact lens bowl. FIG. 5C is a bottom view of contact lens blister package 500 showing strengthening ribs 520, 524, and 528. FIG. 5D is a right-side view of contact lens blister package 500 showing strengthening ribs 520 and 524. FIG. 5E is a front view of contact lens blister package 500 showing strengthening ribs 520, 524, and 528. FIG. 5F is a front, bottom, right perspective view of contact lens blister package 500 showing strengthening ribs 520, 524, and 528. While the details of middle layer 508 cannot be discerned from FIGS. 5A-5F, it is to be understood that the bowl shape, size, contour and configurations, inside and out, can be the same as or substantially similar to the structure shown in FIGS. 4A-4D. It is to be understood that lid 504 can instead be, for example, completely planar such that the volume retained in the sealed bowl defined by lid 504 and middle layer 508, would be greater than the volume provided by the embodiment shown in FIGS. 5A-5F. An air space can be included, if desired, depending upon the volume of the sealed bowl and the volume taken-up by the contact lens and the contact lens solution contained by the blister package.

The present invention includes the following aspects/embodiments/features in any order and/or in any combination:

1. A blister package for a contact lens, the blister package comprising:
   - a body, the body comprising a handle, a bowl, and a body top surface, wherein the bowl is recessed from the body top surface, the handle extends away from the bowl and terminates at a distal end, and the body top surface defines a bowl perimeter sealing surface; and
   - a double layer foil component comprising a sheet of material folded upon itself and defining a seal, a flap, and a fold, the seal and the flap intersecting at the fold, wherein the seal contacts the bowl perimeter sealing surface around the perimeter of the bowl and seals the bowl, the flap is configured to be pulled away from the seal to form a pull tab, and the pull tab is configured to be pulled so that the seal can be separated from the bowl perimeter sealing surface and the bowl can be opened.

2. The blister package of any preceding or following embodiment/feature/aspect, wherein the seal is adhered to the body top surface, and the fold contacts the body between the bowl and the distal end of the handle.
3. The blister package of any preceding or following embodiment/feature/aspect, wherein the fold contacts the body at a line along the handle.
4. The blister package of any preceding or following embodiment/feature/aspect, wherein the seal has a shape and the flap has a shape that mirrors the shape of the seal.
5. The blister package of any preceding or following embodiment/feature/aspect, wherein the double layer foil component comprises aluminium foil.
6. The blister package of any preceding or following embodiment/feature/aspect, wherein the handle comprises a top surface and the seal is adhered to the body at the body top surface and along a portion of the top surface of the handle.
7. The blister package of any preceding or following embodiment/feature/aspect, wherein the handle extends from the body top surface and curves downwardly to the distal end.
8. The blister package of any preceding or following embodiment/feature/aspect, wherein the body has a bottom surface including an outer bottom surface of the bowl, the outer bottom surface of the bowl is arranged on a plane, and the distal end of the handle terminates at the plane.
9. The blister package of any preceding or following embodiment/feature/aspect, wherein the handle has a length and the fold is disposed at a line along the handle and about midway along the length.
10. The blister package of any preceding or following embodiment/feature/aspect, wherein the bowl contains a contact lens, and the flap comprises indicia thereon pertaining to a prescription of the contact lens.
11. The blister package of any preceding or following embodiment/feature/aspect, wherein the body has a maximum width and the pull tab has a width that is equal to the maximum width.
12. The blister package of any preceding or following embodiment/feature/aspect, wherein the body comprises a double wall of foil in an area defining the bowl.
13. The blister package of any preceding or following embodiment/feature/aspect, wherein the bowl has a depth, a beach is provided that intersects with the bowl, the beach has a depth that is shallower than the depth of the bowl, and the bowl perimeter sealing surface surrounds a top opening of the bowl and the beach.
14. An assembly comprising a plurality of blister packages, each blister package comprising a blister package of any preceding or following embodiment/feature/aspect, wherein each blister package has a bowl end and a handle end, and the blister packages are alternately arranged such that, for each adjacent pair of blister packages, the bowl end of one blister package is arranged next to the handle end of the other blister package of the pair.
15. A method of opening a blister package, the blister package comprising a body and a double layer foil component, wherein the body comprises a handle, a bowl, and a body top surface, the bowl being recessed from the body top surface, the handle extending away from the bowl and terminating at a distal end, and the body top surface defining a bowl perimeter sealing surface, and the double layer foil component comprises a sheet of material folded upon itself and defining a seal, a flap, and a fold, the seal and the flap intersecting at the fold, wherein the seal contacts the bowl perimeter sealing surface around the perimeter of the bowl and seals the bowl, the flap is configured to be pulled away from the seal to form a pull tab, and the pull tab is configured to be pulled so that the seal can be separated from the bowl perimeter sealing surface and the bowl can be opened, the method comprising:

pulling the flap toward the handle to form a pull tab extending from the body top surface; and then pulling the pull tab away from the handle to separate the seal from the bowl perimeter sealing surface.

16. The method of any preceding or following embodiment/feature/aspect, further comprising first holding the handle between a thumb and a finger of a first hand, wherein the pulling the flap comprises grabbing the flap with a thumb and finger of a second hand.
17. A blister package for a contact lens, the blister package comprising:

a body, the body comprising a handle, a bowl, and a body top surface, wherein the bowl has a depth, is recessed from the body top surface, and has a top opening, the body comprises a double wall of a foil material defining a sidewall and bottom of the bowl such that the bottom of the bowl is double-walled, the handle extends away from the bowl and terminates at a distal end, and the body top surface defines a perimeter sealing surface surrounding the top opening of the bowl; and a seal contacting the perimeter sealing surface and sealing the bowl.

18. The blister package of any preceding or following embodiment/feature/aspect, where the seal comprises a double layer foil component comprising a sheet of material folded upon itself and defining a seal portion, a flap, and a fold, the seal portion and the flap intersecting at the fold, wherein the seal portion contacts the perimeter sealing surface around the perimeter of the bowl and seals the top opening of the bowl, the flap is configured to be pulled away from the seal to form a pull tab, and the pull tab is configured to be pulled so that the seal portion can be separated from the perimeter sealing surface and the bowl can be opened.
19. The blister package of any preceding or following embodiment/feature/aspect, wherein the entire seal portion is adhered to the body top surface, except for in an area above the bowl, and the fold contacts the body between the bowl and the distal end of the handle.
20. The blister package of any preceding or following embodiment/feature/aspect, wherein the entire body comprises a double layer of foil material including an inner layer and an outer layer, the inner layer defining the bowl and having a top surface that defines an inner surface of the bowl, the outer layer comprising strengthening ribs and defining a bowl support indentation for receiving the bowl formed of the inner layer.

21. A method of forming a blister package, the blister package comprising a body and a seal, wherein
   the body comprises a handle, a bowl, and a body top surface, the bowl having a depth, being recessed from the body top surface, and having a top opening, the body comprising a double wall of a foil material defining a sidewall and a bottom of the bowl such that the bottom of the bowl is double-walled, the handle extending away from the bowl and terminating at a distal end, and the body top surface defining a perimeter sealing surface surrounding the top opening of the bowl, and the method comprises:
   placing a contact lens and contact lens solution in the bowl; and
   sealing the seal against the perimeter sealing surface to seal the bowl.
22. The method of any preceding or following embodiment/feature/aspect, further comprising forming the body from a single piece of material, the forming comprising
   forming the inner body layer comprises forming the bowl in a first section of the single piece of material,
   forming the outer body layer comprises forming the bowl support indentation in a second section of the single piece of material, adjacent to the first section, and
   folding the first section against the second section at a fold formed at an intersection between the first section and the second section, such that (1) the bowl formed in the inner body layer is received in the bowl support indentation of the outer body layer, and (2) together the inner body layer and outer body layer form a double-walled body including the double-walled bowl.
23. The method of any preceding or following embodiment/feature/aspect, further comprising peeling the seal away from the perimeter sealing surface to open the bowl.

The present invention can include any combination of these various features or embodiments above and/or below as set-forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof

What is claimed is:

1. A blister package for a contact lens, the blister package comprising:
   a body, the body comprising a handle, a bowl, and a body top surface, wherein the bowl is recessed from the body top surface, the handle extends away from the bowl and terminates at a distal end, and the body top surface defines a bowl perimeter sealing surface; and
   a double layer foil component comprising a sheet of material folded upon itself and defining a seal, a flap, and a fold, the seal and the flap intersecting at the fold, wherein the seal contacts the bowl perimeter sealing surface around the perimeter of the bowl and seals the bowl, the flap is configured to be pulled away from the seal to form a pull tab, and the pull tab is configured to be pulled so that the seal can be separated from the bowl perimeter sealing surface and the bowl can be opened, wherein
   the bowl contains a contact lens,
   the seal is adhered to the body top surface, and
   the fold contacts the body between the bowl and the distal end of the handle,
   and wherein the handle has a length and the fold is disposed at a line along the handle and about midway along the length.

2. The blister package of claim 1, wherein the fold contacts the body at a line along the handle.

3. The blister package of claim 1, wherein the seal has a shape and the flap has a shape that mirrors the shape of the seal.

4. The blister package of claim 1, wherein the double layer foil component comprises aluminium foil.

5. The blister package of claim 1, wherein the handle comprises a top surface and the seal is adhered to the body at the body top surface and along a portion of the top surface of the handle.

6. The blister package of claim 1, wherein the handle extends from the body top surface and curves downwardly to the distal end.

7. The blister package of claim 6, wherein the body has a bottom surface including an outer bottom surface of the bowl, the outer bottom surface of the bowl is arranged on a plane, and the distal end of the handle terminates at the plane.

8. The blister package of claim 1, wherein the flap comprises indicia thereon pertaining to a prescription of the contact lens.

9. The blister package of claim 1, wherein the body has a maximum width and the pull tab has a width that is equal to the maximum width.

10. The blister package of claim 1, wherein the body comprises a double wall of foil in an area defining the bowl.

11. The blister package of claim 1, wherein the bowl has a depth, a beach is provided that intersects with the bowl, the beach has a depth that is shallower than the depth of the bowl, the bowl perimeter sealing surface surrounds a top opening of the bowl and the beach, and the beach extends in a direction of the handle such that a perimeter of the bowl and the beach combined has a teardrop shape.

12. An assembly comprising a plurality of blister packages, each blister package comprising a blister package of claim 1, wherein each blister package has a bowl end and a handle end, and the blister packages are alternately arranged such that, for each adjacent pair of blister packages, the bowl end of one blister package is arranged next to the handle end of the other blister package of the pair.

13. A blister package for a contact lens, the blister package comprising:

a body, the body comprising a handle, a bowl, and a body top surface, wherein the bowl is recessed from the body top surface, the handle extends away from the bowl and terminates at a distal end, and the body top surface defines a bowl perimeter sealing surface; and a double layer foil component comprising a sheet of material folded upon itself and defining a seal, a flap, and a fold, the seal and the flap intersecting at the fold, wherein the seal contacts the bowl perimeter sealing surface around the perimeter of the bowl and seals the bowl, the flap is lying flat against the seal in an unopened state, the flap being configured to be pulled away from the seal to form a pull tab, and the pull tab is configured to be pulled so that the seal can be separated from the bowl perimeter sealing surface and the bowl can be opened, wherein the bowl contains a contact lens, and wherein the flap fully contacts an entire upper surface of the seal in the unopened state.

* * * * *